US007181924B2

(12) United States Patent
Duffy et al.

(10) Patent No.: US 7,181,924 B2
(45) Date of Patent: Feb. 27, 2007

(54) ASSEMBLY METHOD FOR A REFRIGERATED DISPLAY CASE

(75) Inventors: Martin J. Duffy, Edina, MN (US); Derek R. Lea, Scotland (GB); Denise Y. Slatton, Parrish, FL (US); Marian T. Boultes, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 123 days.

(21) Appl. No.: 11/118,213

(22) Filed: Apr. 29, 2005

(65) Prior Publication Data

US 2006/0242980 A1 Nov. 2, 2006

(51) Int. Cl.
*A47F 3/04* (2006.01)

(52) U.S. Cl. ..... 62/251; 312/116; 312/140.4

(58) Field of Classification Search ..... 62/246–256; 312/116, 140, 140.4
See application file for complete search history.

(56) References Cited

U.S. PATENT DOCUMENTS 2,049,594 A * 8/1936 Stultz ..... 312/128
3,642,146 A * 2/1972 Frazier ..... 211/192
5,593,048 A * 1/1997 Johnson ..... 211/59.2
7,121,104 B2 * 10/2006 Howington et al. ..... 62/256
7,121,417 B2 * 10/2006 Magnusson et al. ..... 211/103

OTHER PUBLICATIONS

Front interior panel and front rack support of a Hussmann Koxka refrigerated display case, publicly disclosed prior to Jan. 1, 2000.

* cited by examiner

*Primary Examiner*—William E. Tapolcai
(74) *Attorney, Agent, or Firm*—Michael Best & Friedrich LLP

(57) ABSTRACT

A refrigerated display case for maintaining food product at a desired temperature. The refrigerated display case includes a case, a product display area, and a refrigeration system. The case includes a plurality of interconnected structural components including a first structural component with first and second sides, a second structural component coupled to the first structural component on the first side with a tab and slot connection, and a third structural component coupled to the first structural component on the second side with a tab and slot connection. The product display area is defined at least in part by the plurality of interconnected structural components and is adapted to support and display the food product. The refrigeration system supplies refrigerated air to the product display area and is adapted to maintain the food product at the desired temperature.

20 Claims, 9 Drawing Sheets

ASSEMBLY METHOD FOR A REFRIGERATED DISPLAY CASE

BACKGROUND

The present invention relates to refrigerated display cases and, more particularly, to assembly systems for refrigerated display cases.

Refrigerated display cases are generally used in retail food store applications such as grocery or convenience stores or other locations where food product is displayed in a refrigerated condition. Refrigerated display cases generally include a case defining a product display area for supporting and displaying food products to be visible and accessible through an opening in the case. The case includes a plurality of structural components that are coupled together by common fasteners such as screws, nuts, and bolts. The assembly of refrigerated display cases is labor intensive and time consuming due in part to the number of the common fasteners used during assembly and the individual attention that each fastener requires from the assembler.

SUMMARY

In one embodiment, the invention provides a refrigerated display case for maintaining food product at a desired temperature. The refrigerated display case includes a case, a product display area, and a refrigeration system. The case includes a plurality of interconnected structural components including a first structural component with first and second sides, a second structural component coupled to the first structural component on the first side with a tab and slot connection, and a third structural component coupled to the first structural component on the second side with a tab and slot connection. The product display area is defined at least in part by the plurality of interconnected structural components and is adapted to support and display the food product. The refrigeration system supplies refrigerated air to the product display area and is adapted to maintain the food product at the desired temperature.

In another embodiment, the invention provides a method of assembling a refrigerated display case. The method includes providing a plurality of structural components of a case of the refrigerated display case. The plurality of structural components includes first, second, and third structural components. The method further includes coupling the second structural component to the first structural component with a tab and slot connection, coupling the third structural component to the second structural component on the side of the second structural component opposite to the first structural component with a tab and slot connection, at least partially defining a product display area with the interconnected plurality of structural components, supporting and displaying food product within the product display area, supplying refrigerated air to the product display area with a refrigeration system, and maintaining the food product at the desired temperature.

In yet another embodiment, the invention provides a refrigerated display case including a case, a product display area, and a refrigeration system. The case includes a plurality of interconnected structural components including a front interior panel with first and second sides, a front shelf support bracket coupled to the front interior panel on the first side with a tab and slot connection, and a front rack support coupled to the front interior panel on the second side with a tab and slot connection. The front rack support includes a tab and the front interior panel includes a slot. The tab is received within the slot. The front interior panel includes a tab and the front shelf support bracket includes a slot. The tab of the front interior panel is received within the slot of the front shelf support bracket. The slots extend in a common direction. The product display area is defined at least in part by the plurality of interconnected structural components and is adapted to support and display the food product. The refrigeration system supplies refrigerated air to the product display area and is adapted to maintain the food product at the desired temperature.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled". are not restricted to physical or mechanical connections or couplings.

Figure 1:
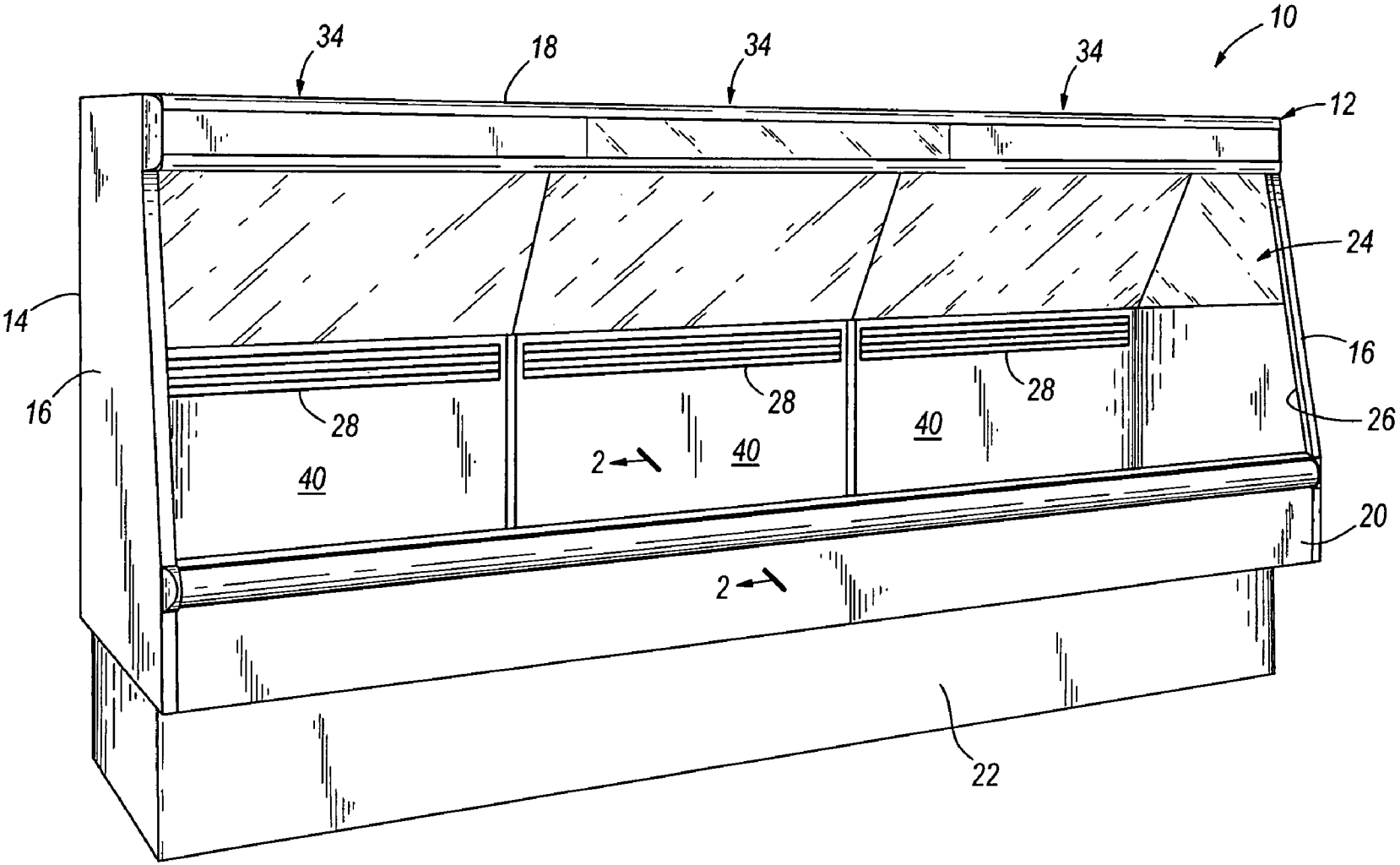
FIG. 1 is a front perspective view of a refrigerated display case according to one embodiment of the invention.

FIG. 1 illustrates a refrigerated display case 10 according to one embodiment of the present invention. The illustrated refrigerated display case 10 is known as a single or multi-deck merchandiser. The present invention is not limited to use with this type of merchandiser, but can also be used on other cases that support, display, and maintain food products at a desired temperature. The refrigerated display case 10 includes a case 12 that includes a rear wall 14, side walls 16 coupled to opposite edges of the rear wall 14, a top wall 18 coupled to the upper edges of the rear and side walls 14, 16, and a front wall 20 coupled between the forward edges of the side walls 16. The case 12 is supported above a support surface by a base 22. The refrigerated display case 10 includes a product display area 24 defined at least in part by the interior portions of the front wall 20, side walls 16, rear wall 14, and top wall 18. The product display area 24 supports and displays food product within the case 12. An opening 26 is defined between the top wall 18 and the front wall 20 and between the front edges of the side walls 16. The opening 26 allows convenient access to the product display area 24.

The refrigerated display case 10 includes a refrigeration system (not shown) that provides refrigerated airflow to the product display area 24. Although not shown, the refrigeration system generally includes an evaporator located within an air passageway internal to the case. Remotely located compressors compress a gaseous refrigerant and direct the compressed refrigerant to an exterior condenser where the refrigerant is cooled and condensed into a liquid refrigerant that is directed to the evaporator. Prior to reaching the evaporators, the liquid refrigerant is forced through an expansion valve converting the refrigerant into a two-phase fluid. The two-phase refrigerant absorbs heat from air being directed though the evaporator by a fan. The refrigerant generally leaves the evaporator in a superheated condition and is routed back to the compressor for recycling. The cooled air exiting the evaporator is directed through the remainder of the air passageway and is introduced into the product display area through an outlet located in the top wall 18 of the case 12. The outlet directs the air into the product display area 24 where it will remove heat from the displayed food products and maintain the food products at the desired temperature. A portion of the cooled air can be directed from the air passageway, through the rear vents 28 (FIG. 1), and into the product display area 24. After being circulated through the product display area 24, the warmed air is routed back into the air passageway through an inlet 30 (FIG. 2) located in a forward portion of the product display area 24. The inlet 30 is covered with a grill 32 (FIG. 2) to prevent debris from entering into the air passageway. Moving air from the outlet in the top wall 18 to the inlet 30 creates an air curtain across the opening 26 separating the cooled air of the product display area 24 from the ambient air outside the case 12. The air returning into the air passageway is again circulated through the evaporator by the fan.

As shown in FIG. 1, the case 12 is constructed by assembling three separate segments 34. The segments 34 are substantially the same length and are connected to each other in a row to form a refrigerated display case 10 having a desired length. In some embodiments, cases 12 can include a single segment 34 or can include any number of multiple segments 34. Some of the components of the refrigerated display case 10 can be segmented while others can be a single piece extending the length of the case 12. The segments 34 of the case 12 are substantially similar and therefore only a single segment 34 is described below.

Figure 2:
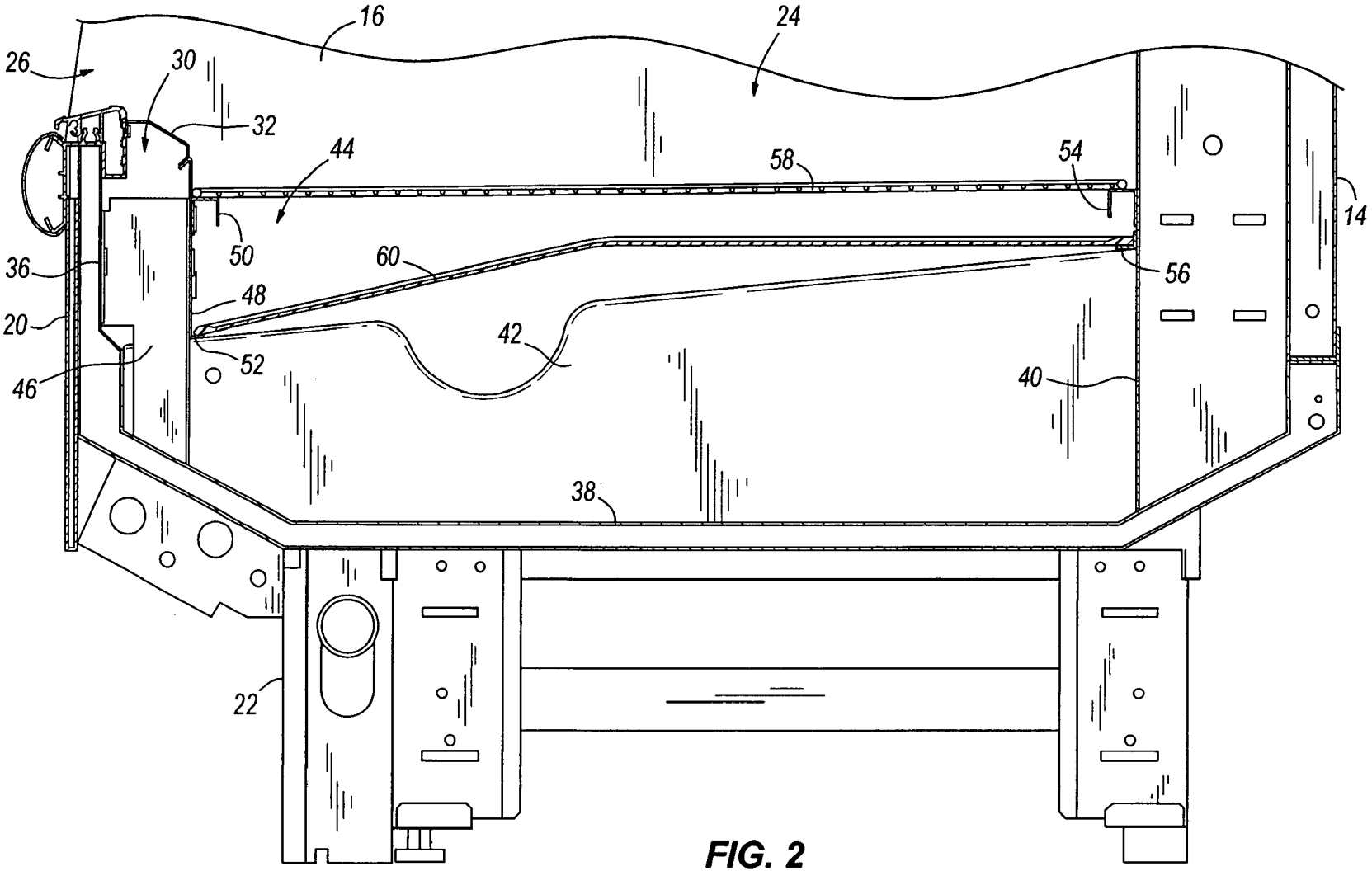
FIG. 2. is a partial cross-section view taken along line 2—2 of FIG. 1, illustrating a shelf support assembly of the refrigerated display case.

As illustrated in FIG. 2, the case 12 includes a front interior wall 36, a bottom interior wall 38, and a rear interior wall 40 that together define a lower cavity. End supports 42 are coupled to the front, bottom, and rear interior walls 36, 38, 40 and are separated from each other to define the ends of the segment 34. End supports 42 are bolted together to connect adjacent segments 34.

Each segment 34 of the case 12 includes a shelf support assembly 44. With reference to FIG. 2, the shelf support assembly 44 includes a plurality of structural components including front shelf support brackets 46 coupled to the front interior wall 36, a front interior panel 48 coupled to the front shelf support brackets 46, and a front rack support 50 coupled to the front interior panel 48. Each of these structural members 46, 48, 50 (including the front interior wall 36) are coupled by tab and slot connections. The front interior panel 48 includes a front tray support 52 along its bottom edge. The shelf support assembly 44 also includes a rear rack support 54, a rear tray support 56, a wire rack 58, and a tray 60. The rear rack support 54 and the rear tray support 56 are connected to the rear interior wall 40 and extend across the length of the segment 34. The tray 60 is supported by the front and rear tray supports 52, 56 and the wire rack 58 is supported by the front and rear rack supports 50, 54. The wire rack 58 supports food product within the product display area 24 and the tray 60 accumulates any spilled fluids that pass through the wire rack 58. In some embodiments, the food product can also be supported on shelves coupled to and extending forwardly from the rear interior wall 40.

The structural components of the shelf support assembly 44 and the method of assembling the shelf support assembly 44 are described in more detail below with reference to FIGS. 3–10.

Figure 3:
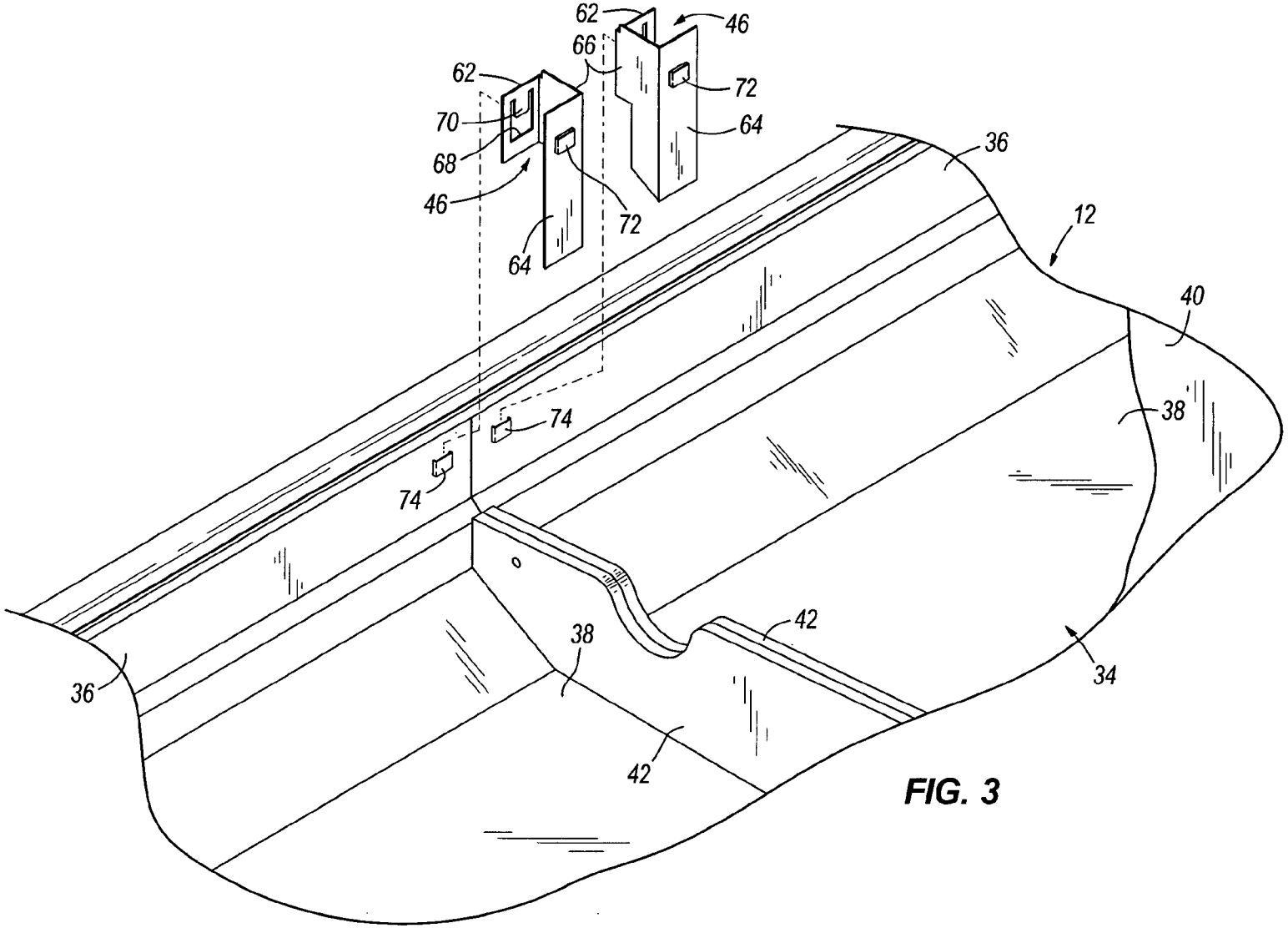
FIG. 3 is a partially cut-away rear perspective view of the refrigerated display case of FIG. 1, illustrating the assembly of front shelf support brackets of the shelf support assembly.

As illustrated in FIG. 3, the front shelf support brackets 46 are located adjacent the end supports 42. The front shelf support brackets 46 are generally C-shaped in cross-section and include a forward portion 62, a rearward portion 64, and a center portion 66 connecting the forward and rearward portions 62, 64. The forward portion 62 includes a cutout 68 including a downwardly projecting tab 70 within the cutout 68. The rearward portion 64 includes a slot 72 that extends slightly away from the rearward portion 64 in the rearward direction. The bottom edge of the center portion 66 is angled to match the angle of the angled portion of the bottom interior wall 38. The front shelf support brackets 46 illustrated in FIG. 3 are shown as mirror images of each other. In other embodiments, the front shelf support brackets 46 can be identically shaped.

Figure 4:
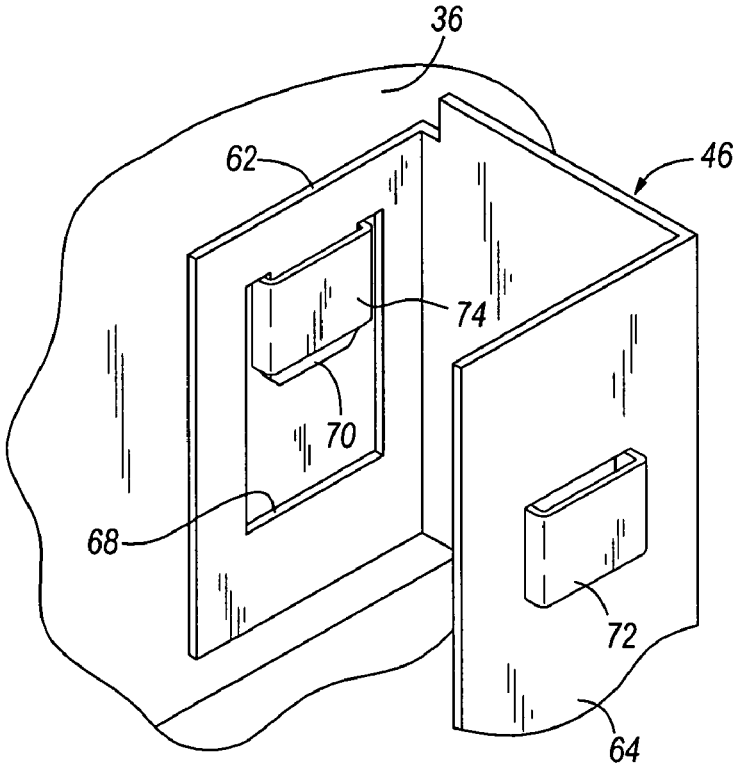
FIG. 4 is an enlarged rear perspective view of a front shelf support bracket of FIG. 3, illustrating the front shelf support bracket coupled to the front interior wall of the refrigerated display case with a tab and slot connection.
Figure 5:
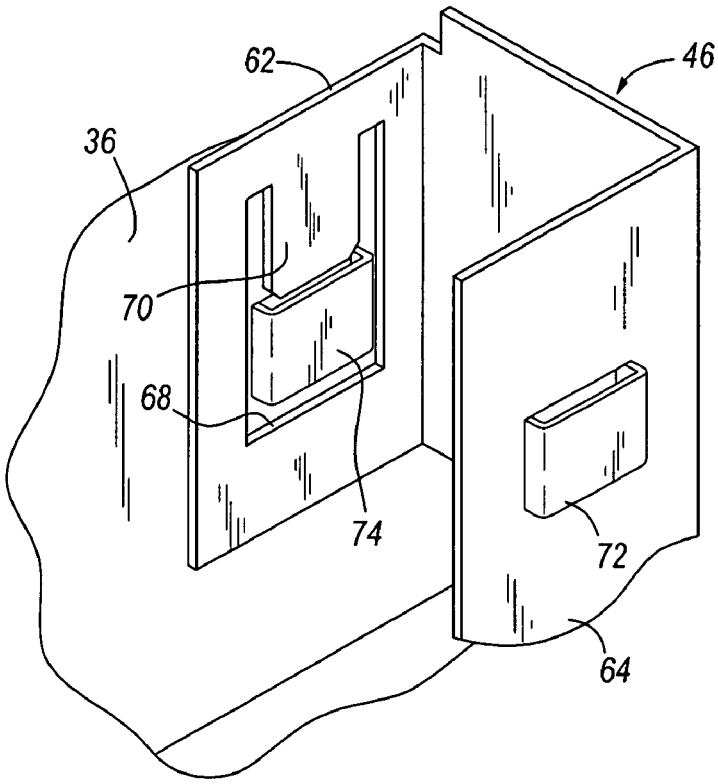
FIG. 5 is a view similar to FIG. 4, illustrating the tab and slot connection uncoupled.

As best shown in FIGS. 4 and 5, the front shelf support brackets 46 are coupled to the front interior wall 36 by a tab and slot connection. The front interior wall 36 includes a rearwardly-extending slot 74. The front shelf support bracket 46 is coupled to the front interior wall 36 by positioning the forward portion 62 of the front shelf support bracket 46 flat against the rearward face of the front interior wall 36 such that the slot 74 is positioned within the cutout 68 below the tab 70. The entire front shelf support bracket 46 is moved downwardly such that the tab 70 is inserted into the slot 74. The slot 74 and tab 70 are configured to provide a secure connection and to reduce and lateral or rotational movement between the front interior wall 36 and the front shelf support bracket 46. The front shelf support bracket 46 is moved downwardly until the tab 70 is fully inserted into the slot 74 and the bottom edge contacts the angled portion of the bottom interior wall 38. Also, the front shelf support bracket 46 can be removed or disconnected from the front interior wall 36 by lifting the front shelf support bracket 46 until the tab 70 is completely removed from the slot 74.

Figure 6:
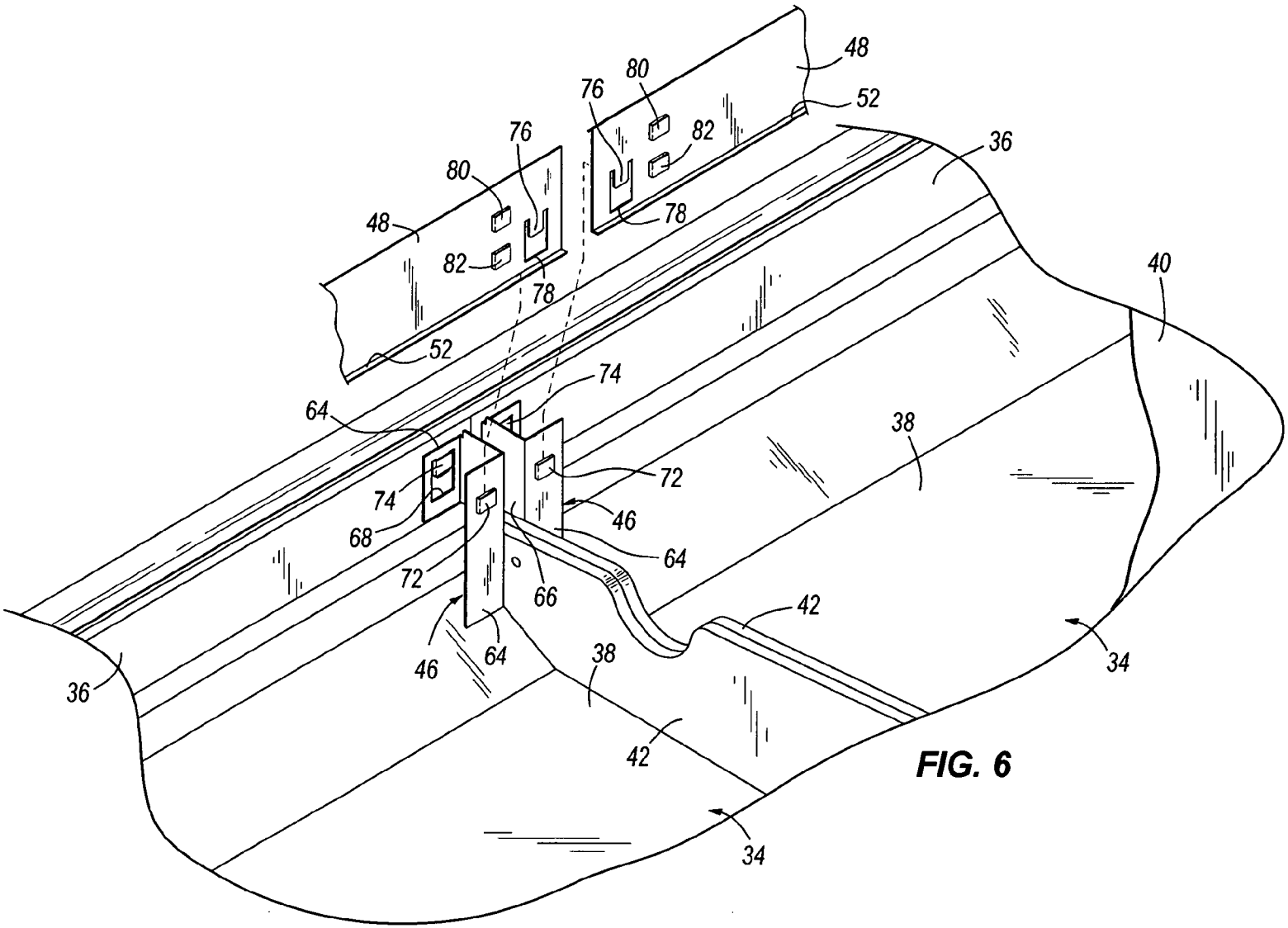
FIG. 6 is a view similar to FIG. 3, illustrating the assembly of front interior panels of the shelf support assembly.

With reference to FIG. 6, the front interior panel 48 extends across a segment 34 and includes a tab 76 adjacent each end. The tab configuration is similar to the front shelf support bracket 46 in that it includes a cutout 78. Immediately inward of each tab 76 is a pair of vertically-aligned, rearwardly extending upper and lower slots 80, 82. The front interior panel 48 is coupled to the front shelf support bracket 46 by positioning the front interior panel 48 against the rearward face of the rearward portion 64 of the front shelf support bracket 46 such that the slots 72 are positioned within the cutouts 78 below the tabs 76. The entire front interior panel 48 is moved downwardly such that the tabs 76 are inserted into the slots 72. The slots 72 and tabs 76 are configured to provide a secure connection and to reduce and lateral or rotational movement between the front interior panel 48 and the front shelf support bracket 46. The front interior panel 48 is moved downwardly until the tabs 76 are fully inserted into the slots 72 and the front tray support 52 contacts the upper edge of the end supports 42. Also, the front interior panel 48 can be removed or disconnected from the front shelf support bracket 46 by lifting the front interior panel 48 until the tabs 76 are completely removed from the slots 72.

Figure 7:
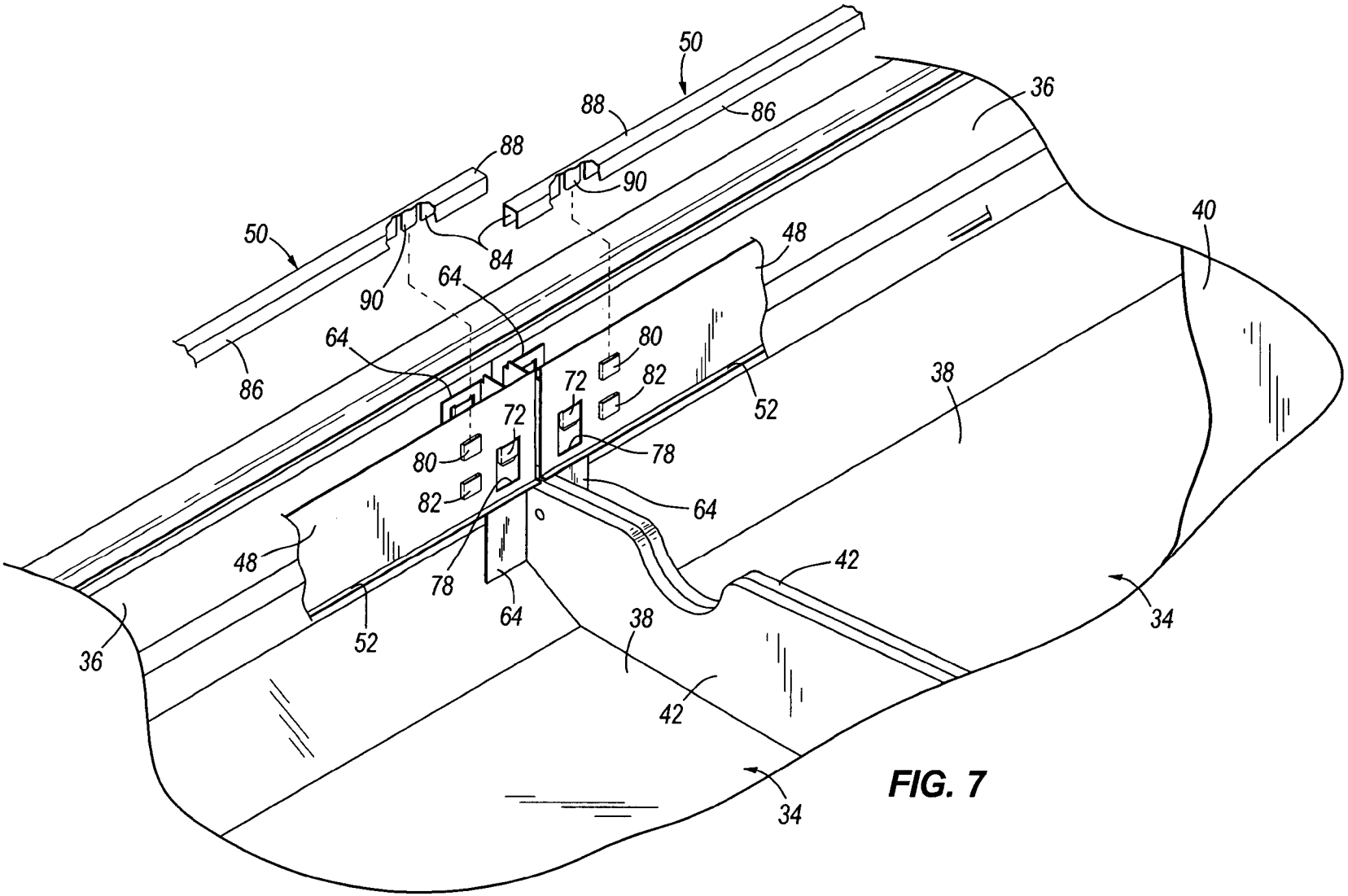
FIG. 7 is a view similar to FIG. 6, illustrating the assembly of front rack supports of the shelf support assembly.

As shown in FIG. 7, the front rack support 50 is generally U-shaped and includes a front portion 84, a rear portion 86, and a center portion 88 extending between the upper edges of the front and rear portions 84, 86. The front rack support 50 extends across a segment 34 and includes a tab 90 adjacent each end on the front portion 84. The tab 90 is similar to the other tabs 70, 76, except that the front rack support 50 does not include a cutout that surrounds the tab 90. The front rack support 50 is coupled to the front interior panel 48 by positioning the front portion 84 against the rearward face of the front interior panel 48 such that the slots 80 are positioned directly below the tabs 90. The entire front rack support 50 is moved downwardly such that the tabs 90 are inserted into the slots 80. The slots 80 and tabs 90 are configured to provide a secure connection and to reduce and lateral or rotational movement between the front interior panel 48 and the front rack support 50. The front rack support 50 is moved downwardly until the tabs 90 are fully inserted into the slots 80. Also, the front rack support 50 can be removed or disconnected from the front interior panel 48 by lifting the front rack support 50 until the tabs 90 are completely removed from the slots 80. The height of the front rack support 50 is adjustable in that the tabs 90 of the front rack support 50 can instead be inserted into the lower slots 82.

Figure 8:
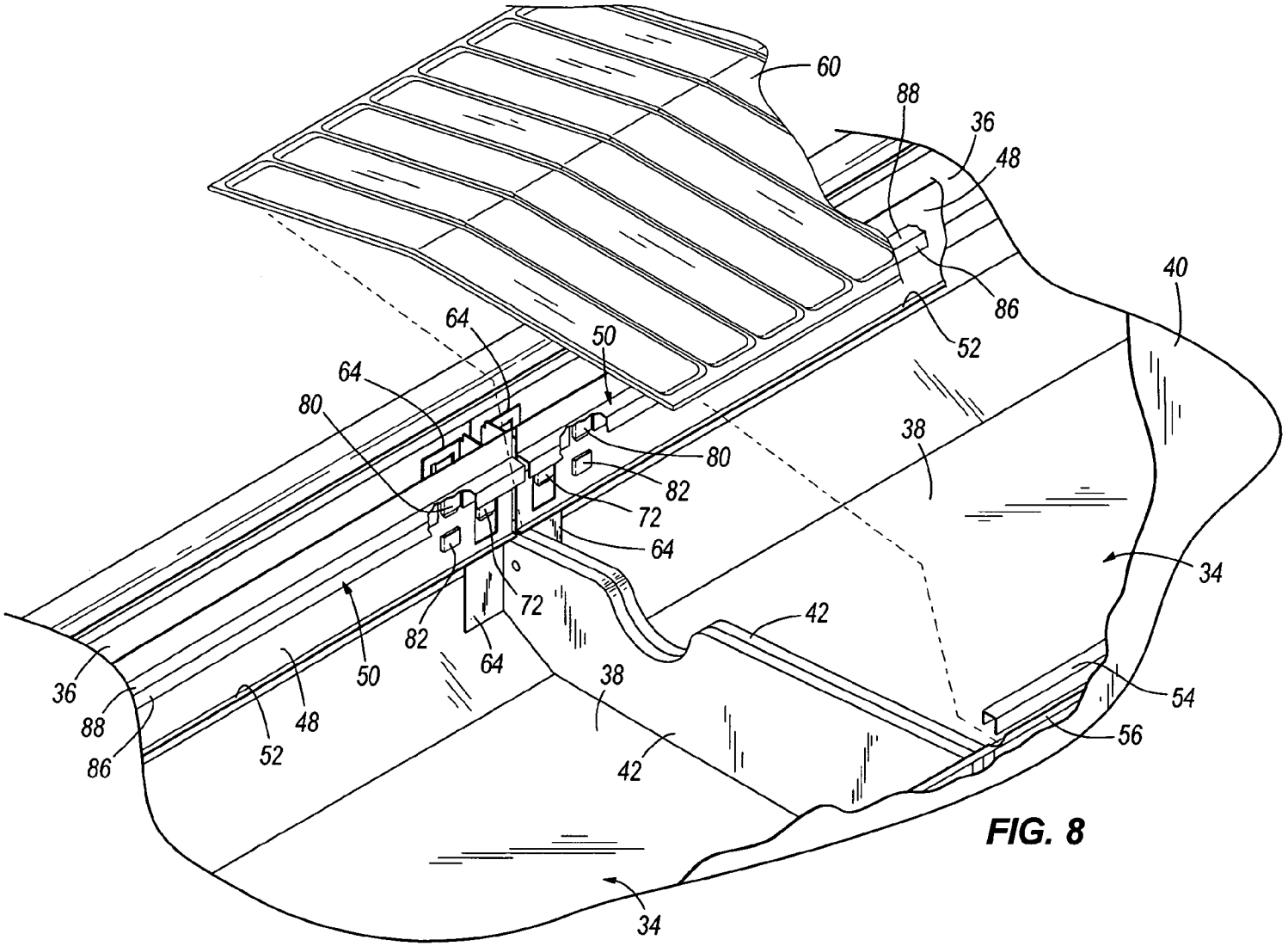
FIG. 8 is a view similar to FIG. 7, illustrating the assembly of a tray of the shelf support assembly.
Figure 9:
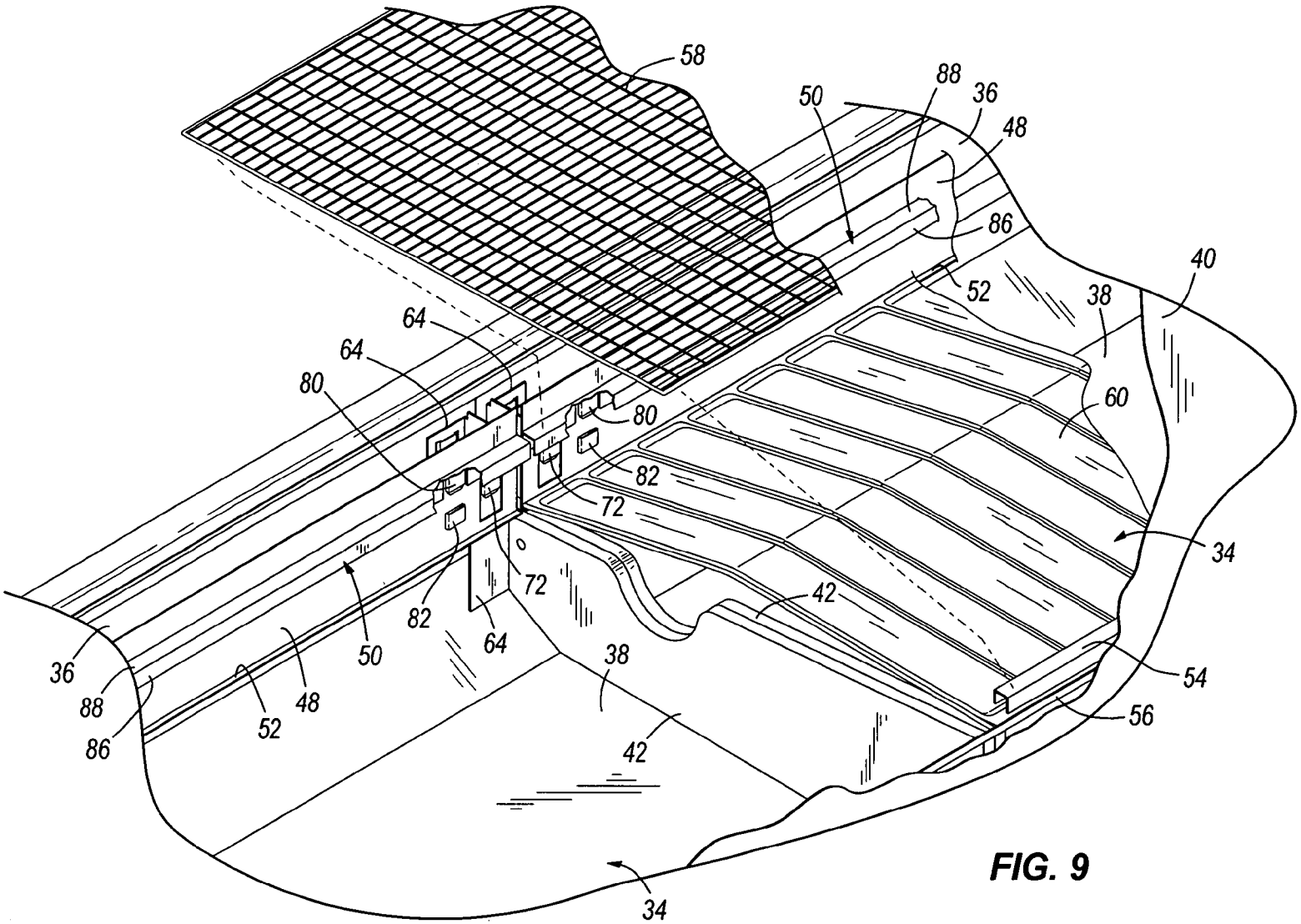
FIG. 9 is a view similar to FIG. 8, illustrating the assembly of a wire rack of the shelf support assembly.
Figure 10:
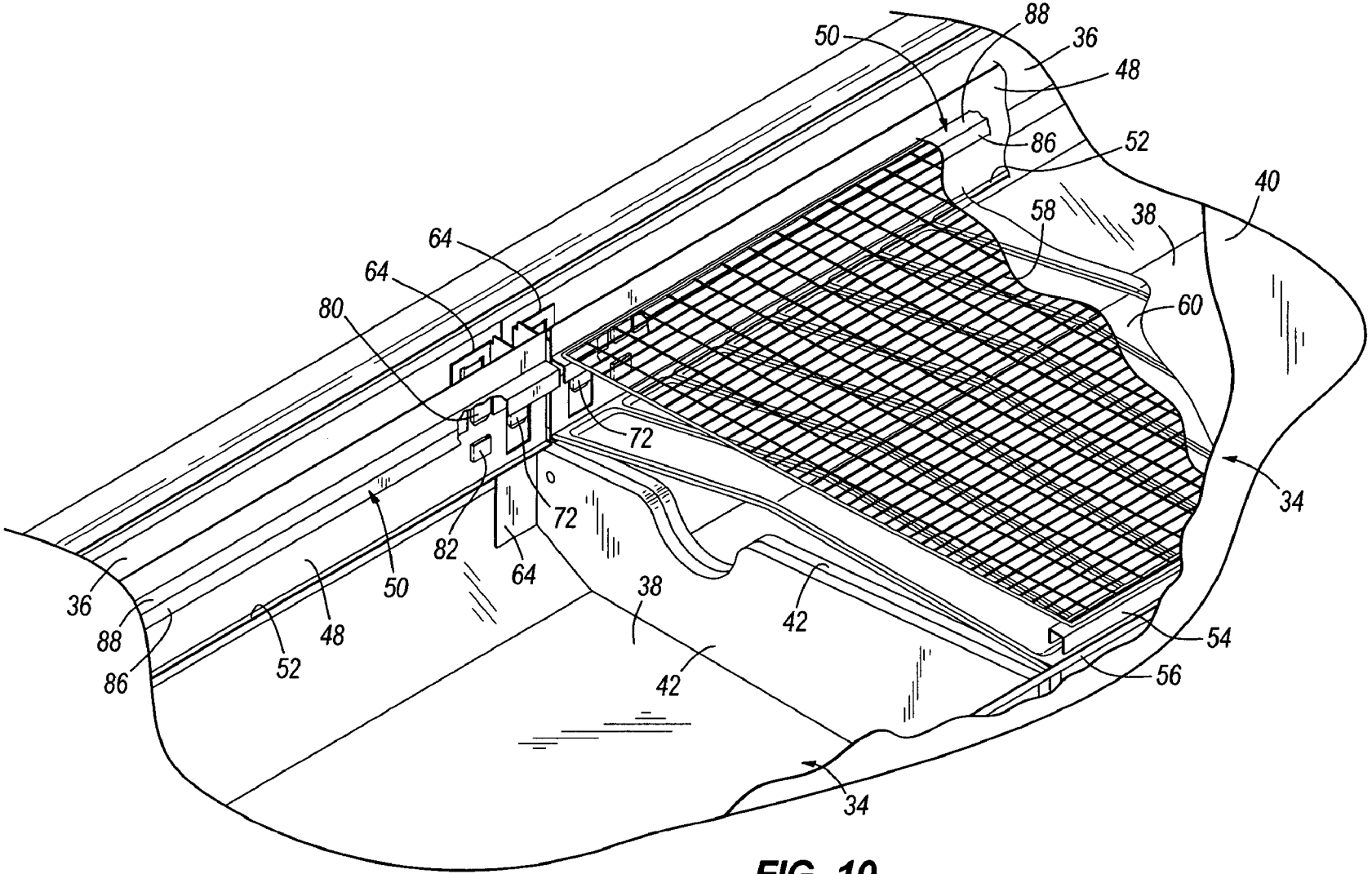
FIG. 10 is a view similar to FIG. 9, illustrating shelf support assembly fully assembled.

FIG. 8 illustrates the assembly of the tray 60 into the shelf support assembly 44. The front edge of the tray 60 is positioned on the front tray support 52 and the rear edge of the tray 60 is positioned on the rear tray support 56. The tray 60 can also be removed by lifting the tray 60 away from the front and rear tray supports 52, 56. With reference to FIG. 9, the wire rack 58 is assembled to the shelf support assembly 44. The front edge of the wire rack 58 is positioned on the front rack support 50 and the rear edge of the wire rack 58 is positioned on the rear rack support 54. The wire rack 58 can also be removed by lifting the wire rack 58 away from the front and rear rack supports 50, 54. FIG. 10 illustrates the shelf support assembly 44 in the fully assembled condition.

The structural components 36, 46, 48, 50 described above can be made from stamped and formed sheet metal. For example, the cutout and tab configurations can be manufactured by using a punch press other stamping equipment to remove material from the sheet. Likewise, this same equipment can be used to create the slots by shearing and displacing material from the structural component. In addition, brake presses or other bending equipment can be used to bend the structural components appropriately.

Although tab and slot connections may have been used in other applications, the tab and slot configuration of the present invention is advantageous because it is used to couple together more than two structural components together. The present invention is used to couple together a series or stack of more than two structural components while maintaining the required strength, rigidity, and integrity of the case. The tab and slot connections of the present invention allow for the stacking of structural components because the structural components include planar mating interfaces in addition to the tab and slot connection. For example, the planar area of forward portion 62 of the front shelf support bracket 46 around the tab 70 makes surface contact with the planar area of the rearwardly facing portion of the front interior wall 36 around the slot 74.

The tab and slot connections allow the structural components of the case 12 to be assembled without the use of common fasteners such as screws, nuts, and bolts. The use of the tab and slot connections simplifies the assembly and reduces the assembly time required to assemble the case 12, thereby decreasing the costs associated with the assembly of the refrigerated display case 10.

Various features and advantages of the invention are set forth in the following claims.

What is claimed is:

1. A refrigerated display case for maintaining food product at a desired temperature, the refrigerated display case comprising:

a case including a plurality of interconnected structural components having a first structural component with first and second sides, a second structural component coupled to the first structural component on the first side with a tab and slot connection, and a third structural component coupled to the first structural component on the second side with a tab and slot connection;

a product display area defined at least in part by the plurality of interconnected structural components, the product display area adapted to support and display the food product; and a refrigeration system supplying refrigerated air to the product display area and adapted to maintain the food product at the desired temperature.

2. The refrigerated display case of claim 1, wherein the first structural component is a front interior panel.

3. The refrigerated display case of claim 2, wherein the front interior panel includes a front tray support.

4. The refrigerated display case of claim 2, wherein the second structural component is a front shelf support bracket.

5. The refrigerated display case of claim 4, wherein the third structural component is a front rack support.

6. The refrigerated display case of claim 5, wherein the front rack support includes a tab and the front interior panel includes a slot, wherein the tab is received within the slot.

7. The refrigerated display case of claim 6, wherein the front panel includes an additional slot at a different height than the height of the slot such that the tab of the front rack support can alternatively be received in the additional slot to adjust the height of the front shelf support bracket.

8. The refrigerated display case of claim 6, wherein the front interior panel includes a tab and the front shelf support bracket includes a slot, wherein the tab of the front interior panel is received within the slot of the front shelf support bracket.

9. The refrigerated display case of claim 6, wherein the plurality of interconnected components includes a front interior wall, the front shelf support bracket being coupled to the front interior wall by a tab and slot connection.

10. The refrigerated display case of claim 1, wherein the plurality of interconnected components includes a fourth structural member coupled to the second structural member on the side opposite to the first structural member by a tab and slot connection.

11. The refrigerated display case of claim 1, wherein each tab and slot connection includes a tab and a slot, wherein the slots of the tab and slot connections extend in a common direction.

12. The refrigerated display case of claim 11, wherein the first side is closer to the front of the case than the second side, and wherein the slots extend toward the rear side of the case.

13. A method of assembling a refrigerated display case, the method comprising:

providing a plurality of structural components of a case of the refrigerated display case, the plurality of structural components including first, second, and third structural components;

coupling the second structural component to the first structural component with a tab and slot connection;

coupling the third structural component to the second structural component on the side of the second structural component opposite to the first structural component with a tab and slot connection;

at least partially defining a product display area with the interconnected plurality of structural components;

supporting and displaying food product within the product display area;

supplying refrigerated air to the product display area with a refrigeration system; and maintaining the food product at the desired temperature.

14. The method of claim 13, wherein coupling the second structural component includes inserting a tab of the second structural component into a slot of the first structural component.

15. The method of claim 14, wherein coupling the third structural component includes inserting a tab of the third structural component into a slot of the second structural component.

16. The method of claim 13, further comprising coupling a fourth structural component to the third structural component on the side of the third structural component opposite to the second structural component with a tab and slot connection.

17. The method of claim 16, further comprising supporting a wire rack onto the fourth structural component.

18. The method of claim 17, further comprising supporting a tray onto the third structural component.

19. The method of claim 16, further comprising removing the fourth structural component from the third structural component, and coupling the fourth structural component to the third structural component at a different height on the side of the third structural component opposite to the second structural component with a tab and slot connection.

20. A refrigerated display case for maintaining food product at a desired temperature, the refrigerated display case comprising:

a case including a plurality of interconnected structural components having a front interior panel with first and second sides, a front shelf support bracket coupled to the front interior panel on the first side with a tab and slot connection, and a front rack support coupled to the front interior panel on the second side with a tab and slot connection, wherein the front rack support includes a tab and the front interior panel includes a slot, wherein the tab is received within the slot, wherein the front interior panel includes a tab and the front shelf support bracket includes a slot, wherein the tab of the front interior panel is received within the slot of the front shelf support bracket, wherein the slots extend in a common direction;

a product display area defined at least in part by the plurality of interconnected structural components, the product display area adapted to support and display the food product; and a refrigeration system supplying refrigerated air to the product display area and adapted to maintain the food product at the desired temperature.

* * * * *